US007854270B2

(12) United States Patent
Wagner

(10) Patent No.: US 7,854,270 B2
(45) Date of Patent: Dec. 21, 2010

(54) INERTIZATION METHOD FOR REDUCING THE RISK OF FIRE

(75) Inventor: Ernst-Werner Wagner, Winsen (DE)

(73) Assignee: Amrona AG (CH), Zug (CH)

( * ) Notice: Subject to any disclaimer, the term of this patent is extended or adjusted under 35 U.S.C. 154(b) by 0 days.

(21) Appl. No.: 10/584,905

(22) PCT Filed: Nov. 23, 2004

(86) PCT No.: PCT/EP2004/013285

§ 371 (c)(1),
(2), (4) Date: May 16, 2007

(87) PCT Pub. No.: WO2005/063337

PCT Pub. Date: Jul. 14, 2005

(65) Prior Publication Data

US 2008/0011492 A1 Jan. 17, 2008

(30) Foreign Application Priority Data

Dec. 29, 2003 (EP) ..... 03029927

(51) Int. Cl.

| | |
|---|---|
| ***A62C 2/00*** | (2006.01) |
| ***A62C 35/00*** | (2006.01) |
| ***A62C 8/00*** | (2006.01) |
| ***A62C 3/00*** | (2006.01) |
| ***A62C 3/06*** | (2006.01) |
| ***E21B 35/00*** | (2006.01) |

(52) U.S. Cl. ..... 169/45; 169/11; 169/16; 169/43; 169/46; 169/47; 169/49; 169/54; 169/67; 169/69

(58) Field of Classification Search ..... 169/45, 169/47, 49, 67, 69, 11, 16, 43, 46, 54
See application file for complete search history.

(56) References Cited

U.S. PATENT DOCUMENTS 3,467,349 A * 9/1969 Gautier ..... 244/135 R
3,840,667 A * 10/1974 Huggett ..... 514/771
5,759,430 A * 6/1998 Tapscott et al. ..... 252/8

(Continued)

FOREIGN PATENT DOCUMENTS

DE 198 11 851 9/1999
DE 19811851 A1 * 9/1999

*Primary Examiner*—Len Tran
*Assistant Examiner*—Steven M Cernoch
(74) *Attorney, Agent, or Firm*—Jean C. Edwards, Esq.; Akerman Senterfitt LLP

(57) ABSTRACT

In the event of a failure of a fire prevention or extinguishing system, an inertization method reduces the fire risk in an enclosed protected area, where the oxygen content in the area can be maintained on a control concentration that lies below an operating concentration for a certain time period, so that the emergency operation phase is sufficiently long to prevent the ignition and/or re-ignition of combustible materials therein. The control concentration is maintained for an emergency operation period by a redundant secondary source. Alternatively, the control concentration and the operating concentration, while forming a safety margin, can be lowered so far below the design concentration that in the event of a primary source failure, the growth curve of the oxygen content reaches a limit concentration determined for the area in a predefined period, which is sufficiently long to continue to prevent the ignition and/or re-ignition of the combustible materials.

7 Claims, 2 Drawing Sheets

U.S. PATENT DOCUMENTS 6,341,572 B1 * 1/2002 Howell et al. ..... 114/230.12
6,739,399 B2 * 5/2004 Wagner et al. ..... 169/45
7,156,184 B2 * 1/2007 Wagner ..... 169/45
7,337,856 B2 * 3/2008 Lund et al. ..... 169/6
2002/0070035 A1 * 6/2002 Grabow et al. ..... 169/16
2003/0094288 A1 * 5/2003 Wagner et al. ..... 169/43
2003/0226669 A1 * 12/2003 Wagner ..... 169/45

* cited by examiner

INERTIZATION METHOD FOR REDUCING THE RISK OF FIRE

CROSS-REFERENCE TO RELATED APPLICATIONS

The present application is a 35 U.S.C. 371 national stage entry of international application PCT/EP2004/013285 filed Nov. 23, 2004, which claims priority from EP application No. 03029927.5 filed Dec. 29, 2003, the contents of which are herein incorporated by reference in their entirety.

BACKGROUND OF THE INVENTION

1. Field of the Invention

The present invention relates to an inertization device and method for lowering the risk of fire in an enclosed protected area, in which the oxygen content in the protected area is maintained in a defined control range for a defined period at a control concentration that lies below an operating concentration, by feeding an oxygen-displacing gas from a primary source.

2. Description of the Related Art

Inertization methods for preventing and extinguishing fire in enclosed areas are known from fire extinguishing technology. The extinguishing effect resulting with this method is based on the principle of oxygen displacement. It is known that regular ambient air consists of 21% by volume oxygen, 78% by volume nitrogen and 1% by volume other gases. For extinguishing purposes, the nitrogen concentration in the affected area is increased further, for example by feeding pure nitrogen as an inert gas, thus lowering the oxygen percentage. It is a known fact that an extinguishing effect is achieved when the oxygen percentage drops to less than about 15% by volume. Depending on the combustible materials present in the affected area, further lowering of the oxygen percentage, for example to 12% by volume, may be required. At this oxygen concentration, most combustible materials are no longer able to burn.

The oxygen-displacing gases used with this "inert gas extinguishing technique" are generally stored in the compressed state in steel cylinders in special ancillary rooms. It is furthermore conceivable to use a device for producing a gas that will displace the oxygen. These steel cylinders and/or this device for producing the gas that will displace the oxygen constitute the primary source of the inert gas fire extinguishing system. Where necessary, the gas can then be conducted from this primary source via pipe systems and corresponding discharge nozzles into the affected area.

The associated inert gas fire extinguishing system generally includes at least one installation for the sudden feeding of oxygen-displacing gas from the primary source to the monitored area and a fire detection device for detecting a fire parameter in the air.

Designing the entire fire prevention and/or inert gas fire extinguishing system at the highest possible safety level necessitates equipment and logistics planning in the event of a system shutdown as a result of malfunctions in order to comply with safety requirements. While during the project engineering phase of the fire prevention and/or inert gas fire extinguishing system, all measures allowing the system to be restarted as quickly and smoothly as possible have been taken into consideration, the inertization by means of the inert gas technique is also associated with certain problems and has clear limits in terms of a fail-safe performance. It has turned out that while it is possible to design the inert gas fire extinguishing system such that the probability of the event of a malfunction during the lowering and/or control phases of the oxygen content in the protected area to a control concentration that is below a predefined operating concentration is relatively low, the problem often arises that the control concentration has to be maintained for an extended period of time, during the so-called emergency operation phase, at the required level, particularly because the inertization methods known from the prior art offer no possibility of preventing a re-ignition level of the oxygen concentration in the protected area from being exceeded too early if due to a malfunction the primary source fails completely or at least partially.

The re-ignition phase designates the time period following the fire fighting phase, during which the oxygen concentration in the protected area must not exceed a defined level—the so-called re-ignition prevention level—so as to prevent renewed ignition of the materials present in the protected area. The re-ignition prevention level is an oxygen concentration that depends on the fire load of the protected area and is determined on the basis of experiments. According to German VdS Guidelines, when flooding the protected area, the oxygen concentration in the protected area must reach the re-ignition prevention level of for example 13.8% by volume within the first 60 seconds following the start of flooding (fire fighting phase). Moreover, the re-ignition prevention level must not be exceeded within 10 minutes following the end of the fire fighting phase. To this end it is provided that the fire is completely extinguished in the protected area during the fire fighting phase.

With the inertization methods known from the prior art, the oxygen concentration is lowered as quickly as possible to a so-called operating concentration when a detection signal is issued. The required inert gas is provided by the primary source of the inert gas fire extinguishing system. The term "operating concentration" should be interpreted as a level below a so-called design concentration. The design concentration is an oxygen concentration in the protected area at which the combustion of any material present in the protected area is effectively prevented. When defining the design concentration of a protected area, for safety purposes generally a margin is deducted from the limit at which the combustion of any materials in the protected area is prevented. Upon reaching the operating concentration in the protected area, the oxygen concentration is typically maintained at a control concentration that is below the operating concentration.

The control concentration is a control range for the residual oxygen concentration in the inertized protected area, within which the oxygen concentration is maintained during the re-ignition phase. The control range is defined by an upper limit, the on-threshold for the primary source of the inert gas fire extinguishing system, and a lower limit, the off-threshold for the primary source of the inert gas fire extinguishing system. During the re-ignition phase, the control concentration is maintained in this control range by repeatedly feeding inert gas. The inert gas is typically provided from the reservoir of the inert gas fire extinguishing system that serves as the primary source, i.e., either the device for producing the oxygen-displacing gas (such as a nitrogen generator), gas bottles or other buffer devices. In the event of a malfunction or failure, the risk exists that the oxygen concentration in the protected area will increase prematurely and that the re-ignition prevention level will be exceeded, thus shortening the re-ignition phase and eliminating the guarantee that the fire in the protected area can be fought successfully.

Accordingly, an inert gas fire extinguishing system and/or an inertization method, that overcome these obstacles, is needed.

SUMMARY OF THE INVENTION

Proceeding from the above-described problems regarding the safety requirements of an inert gas fire extinguishing system and/or an inertization method, it is the object of the present invention to further develop the inertization method known from the state of the art and explained above such that the emergency operation phase is sufficiently long, even in the event of a malfunction that affects the primary source, to effectively prevent the ignition or re-ignition of combustible materials in the protected area. Another object of the invention is to provide a corresponding inert gas fire extinguishing system for implementing the method.

This object is achieved with an inventive inertization method of the type mentioned above as a first alternative in that the control concentration for the emergency operation period is maintained by a secondary source in the event of a malfunction of the primary source.

This object is furthermore achieved in that with the aforementioned inertization method the control concentration and the operating concentration are lowered so far beneath the design concentration defined for the protected area, while forming a failure safety margin, that in the event of a malfunction of the primary source the growth curve of the oxygen content will reach a limit concentration defined for the protected area only in a predefined time.

The technical problem underlying the present invention is furthermore solved with a device for implementing the afore-described method, which device is characterized in that the primary source and/or the secondary source is a machine that produces oxygen-displacing gas, a cylinder array, a buffer volume or a deoxydation machine or the like.

The advantages of the invention are particularly that an easy-to-implement and at the same time, very effective inertization method for reducing the risk of fire in an enclosed protected area can be achieved, where even in the event of a malfunction, i.e., for example the failure of the primary source from which the inert gas used for adjusting the control concentration in the protected area originates, the control concentration is maintained for an emergency operation period by means of a secondary source (i.e., first alternative).

The term "primary source" in this context should be interpreted as the inert gas reservoir, such as a nitrogen generator, a gas bottle array in which the inert gas is present in compressed form, or a different kind of buffer volume. In a similar sense, the term "secondary source" is a reservoir redundant of the primary source, which reservoir in turn should be interpreted as a nitrogen generator, a cylinder array or any type of buffer volume.

One important aspect of the present invention is that the secondary source is configured to be redundant from the primary source so as to mutually uncouple the two systems and lower the proneness to malfunctions of the inertization method. To this end it is provided that the secondary source is designed to maintain the control concentration for an emergency operation period in the event of a failure of the primary source, which period is sufficiently long to be able to provide, for example, at least a 10-minute re-ignition phase or an 8-hour emergency operation phase in the protected area, during which the oxygen content in the protected area does not exceed the re-ignition prevention level. Of course it is also conceivable to configure the secondary source corresponding to any arbitrary emergency operation period.

The second alternative is configured such that the limit concentration is, for example, the re-ignition prevention level for the protected area. This is an oxygen concentration, at which level it is guaranteed that combustible materials in the protected area can no longer become ignited. It is provided to lower the operating concentration so much right from the beginning that the growth curve of the oxygen concentration reaches the threshold level only after a certain period of time. This defined period is for example 10, 30 or 60 minutes for a fire extinguishing system and 8, 24 or 36 hours for a fire prevention system until service technicians with spare parts can arrive, and thus enable the implementation of a re-ignition phase and/or emergency operation phase, during which the oxygen content does not exceed a re-ignition prevention level and thus, effectively prevents the ignition and/or re-ignition of combustible materials in the protected area. Lowering the operating concentration, i.e., by defining the operating concentration below the design concentration of the protective room, while forming a failure safety margin, offers an alternative to the above-described embodiments of the inertization method according to the invention, which likewise guarantees that the oxygen concentration is maintained below a defined value, advantageously below the re-ignition prevention level, for an emergency operation period in the event that the primary source fails.

Of course it is also conceivable to combine the two alternatives. Additionally it is possible to take further measures, such as the implementation of operating restrictions, for example temporary limitation of access, in order to extend the emergency operation period.

The device according to the invention offers the possibility of conducting the afore-described method. To this end it is provided that the primary source and/or the secondary source is any reservoir, such as a machine producing oxygen-displacing gas, a cylinder array in which the inert gas is present in compressed form, another type of buffer volume or also an oxygen-removing machine or the like. Instead of producing oxygen-displacing gas, it is also conceivable to remove oxygen from the air in the area, for example by means of fuel cells. Both stationary and mobile installations are possible secondary sources, such as an extinguishing agent tank with an evaporator on a truck. The switch between the primary and secondary sources is carried out either manually or automatically.

In one preferred method, the operating concentration is equal to or substantially equal to a design concentration defined for the protected area. Further developing the method this way makes it possible to lower the consumption of inert gas and/or extinguishing agent for the protected area to an optimal level in that the operating concentration is defined for an oxygen concentration in the protected area, at which concentration the materials of the protected area can no longer ignite. When defining the design concentration, it is preferred if a margin is deducted from the concentration at which the materials of the protected area are just barely no longer combustible.

It is particularly preferred if the failure safety margin is determined by taking an air change rate applicable for the protected area, particularly an $n_{50}$ level for the protected area, and/or the pressure differential between the protected area and the surrounding area into consideration. In order to enable the best possible adaptation of the method according to the invention to the affected protected area it is provided that the failure safety margin increases as the $n_{50}$ level of the target area increases.

In a particularly preferred embodiment it is provided that the design concentration be lowered by a safety margin below the limit concentration defined for the protected area in order to further increase the fail-safe performance of the system. This way it can be guaranteed that the oxygen content remains below the re-ignition prevention level and/or the limit concentration, for example, during the period until the secondary source is ready. It is conceivable for the safety margin to be determined while taking the limit concentration and/or the air change rate n50 into consideration; this means that $S=\alpha([O_{2,Luft}]-GK)$, with S being the safety margin, $[0_{2,Luft}]$ being the oxygen concentration in the air of the protected ara, GK being the re-ignition prevention level, and $\alpha$ being a predefined factor. Consequently, for $\alpha=20\%$, $[0_{2,Luft}]=20.9\%$ by volume, GK=16% by volume, a safety margin results of S=1% by volume and for $\alpha=20\%$, $[0_{2,Luft}]=20.9\%$ by volume, GK=13% by volume, a safety margin results of S=1.6% by volume.

In a particularly preferred embodiment furthermore, a detector is provided for detecting a fire parameter, wherein the oxygen content in the protected area is lowered rapidly to the control concentration when an incipient fire or a fire is detected if the oxygen content previously was at a higher level.

By further designing the inertization method according to the invention it is now possible to implement the method for example, also in a multi-stage inertization method.

It is provided according to the invention that the protected area initially has a correspondingly higher level, for example in order to allow persons to access it. This higher level can either be the concentration of the air in the area (21% by volume) or a first or basic inertization level, for example of 17% by volume. It is conceivable that first the oxygen content in the protected area is lowered to a defined basic inertization level of for example 17% by volume, and is then lowered further to a certain full inertization level down to the control concentration in the event of a fire. A basic inertization level of 17% by volume oxygen concentration does not place persons or animals at any risk whatsoever, so that they can still enter the room without difficulty. The full inertization level and/or the control concentration can be adjusted following the detection of an incipient fire, however it is also conceivable to adjust this level during the night, when no persons are entering the affected room anyhow. With the control concentration the flammability of all materials in the protected area is lowered so far that the materials are no longer combustible. By providing a redundant secondary source, or alternatively thereto by lowering the oxygen concentration, it is advantageously achieved that the fail-safe performance of the inertization method is further increased since now it is guaranteed that sufficient fire protection exists even in the event of a failure of the primary source.

The control range is preferably about ±0.2% by volume and preferably no more than ±0.2% by volume oxygen content around the control concentration in the protected area. This is a range, which is defined by upper and lower threshold values, which are about 0.4% by volume and preferably no more than 0.4% by volume apart. The two threshold values designate the residual oxygen concentrations at which the secondary source is turned on or off so as to maintain or achieve the target value in the event the primary source fails. Of course different orders of magnitude for the control range are conceivable as well.

In order to achieve the best possible adaptation of the inertization method to the affected protective area, it is provided in a preferred embodiment of the inertization method according to the invention that the oxygen content in the protected area is controlled while taking the air change rate, particularly the $n_{50}$ level of the protected area, and/or the pressure differential between the protected area and surrounding area into consideration. This is a level, which designates the relation of the produced leakage volume flow to the existing volume for a generated pressure differential to the surrounding area of 50 Pa. The $n_{50}$ level is therefore a measure for the tightness of the protected area and consequently an important variable for the dimensioning of the inert gas fire extinguishing system and/or for the design of the inertization method in terms of the fail-safe performance of the primary source.

It is preferred if the $n_{50}$ level is determined by means of the so-called blower door measurement in order to be able to assess the tightness of the encompassing components that delimit the protected area. For this purpose, a standardized high or low pressure of 10 to 60 Pa is produced in the protected area. The air escapes via leaking surfaces of the encompassing components to the outside or penetrates from there. A corresponding measuring device measures the volume flow required for maintaining the pressure differential necessary for the measurement, for example 50 Pa. Subsequently, a measurement program computes the $n_{50}$ value, which relates to the produced pressure differential of 50 Pa in a standardized fashion. The blower door measurement should be performed prior to the concrete design of the inertization method according to the invention, particularly prior to the design of the secondary source provided according to the invention, which source is redundant of the primary source, and/or prior to the design of the failure safety margin in the alternative inertization method.

In a particularly preferred further development of the method according to the invention, it is provided that the extinguishing agent volume required for maintaining the control concentration in the protected area is computed while taking the $n_{50}$ air change rate into consideration. Accordingly it is possible to design the amount and/or the capacity of the primary source and/or of the secondary source as a function of the $n_{50}$ value, and therefore precisely adapt it to the protected area.

BRIEF DESCRIPTION OF THE DRAWINGS

The method according to the invention will be explained in more detail hereinafter with reference to the figures, wherein.

DESCRIPTION OF THE INVENTION

Figure 1:
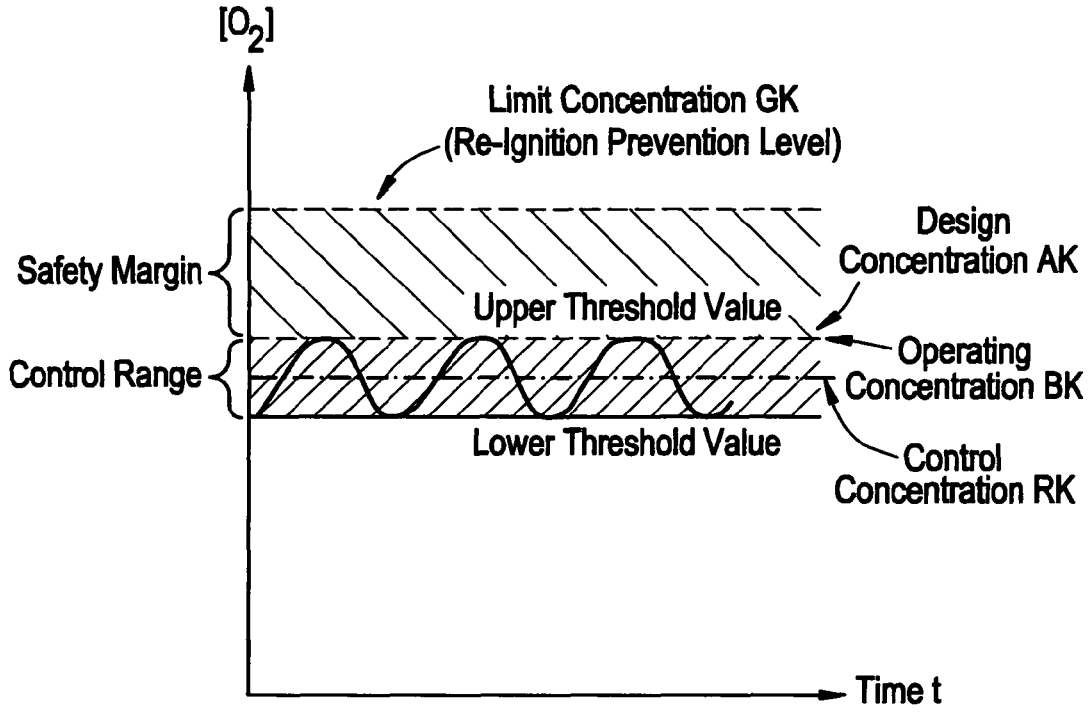
FIG. 1 shows a section of a course over time of the oxygen concentration in a protected area, with the operating concentration and the control concentration of the oxygen content according to the first alternative of the inertization method according to the invention being maintained by means of a secondary source.

FIG. 1 shows a section of a course over time of the oxygen concentration in a protected area, with the operating concentration BK and the control concentration RK of the oxygen content according to the first alternative of the inertization method according to the invention being maintained by means of a secondary source. In the illustrated graph, the y-axis represents the oxygen content in the protected area and the x-axis represents time. In the present case, the oxygen content in the protected area has already been lowered to a so-called full inertization level, i.e., to a control concentration RK that is below an operating concentration BK.

In the scenario illustrated schematically in FIG. 1, the operating concentration BK exactly corresponds to the design concentration AK. The design concentration AK is an oxygen concentration value in the protected area, which is in principle below a limit concentration GK that is specific for the protected area. The limit concentration GK, which is frequently also referred to as the "re-ignition prevention level", relates to the oxygen content in the atmosphere of the protected area, at which a defined substance can no longer be ignited with a defined ignition source. The respective value of the limit concentration GK has to be determined experimentally and is the basis for determining the design concentration AK. For this, a safety margin is deduced from the limit concentration GK.

In principle, the operating concentration BK must not exceed the design concentration AK. When taking the safety concept for the inert gas fire extinguishing system and/or the employed inertization method into consideration, the operating concentration BK is obtained. In order to keep the operating costs of the inert gas fire extinguishing system as low as possible, it is preferred to select the margin between the operating concentration BK and the design concentration AK as small as possible because any decreases in the oxygen concentration beyond the required protected level are associated with increased use of extinguishing agents and/or inert gas.

In the course over time of the oxygen concentration illustrated in FIG. 1, furthermore, a control concentration RK is provided, which is in the center of a control range, the upper limit of the control range being identical to the operating concentration BK. The control concentration RK represents a concentration value, by which the oxygen concentration fluctuates in the protected area. It is provided that the fluctuations take place in the control range. When the oxygen content in the control range reaches the upper limit (in this case the operating concentration BK), then the oxygen content in the protected area is lowered again by feeding inert gas until the lower limit of the control range has been reached, whereupon further feeding of inert gas into the protected area is suspended. Accordingly, the upper limit of the control range corresponds to an upper threshold value for feeding the inert gas and the lower limit of the control range corresponds to a lower threshold value at which further feeding of the inert gas into the protected area is suspended. In other words, the upper threshold value corresponds to an activation of a primary or secondary source, and the lower threshold value corresponds to a deactivation of the primary or secondary source.

According to the invention, it is provided that even in the event of a failure of the primary source, the oxygen concentration can be maintained in the control range around the control concentration RK for a sufficiently long time. To this end, it is provided that the secondary source is configured redundant of the primary source. The time during which, by means of feeding inert gas from a primary source, and the emergency operation period during which the control concentration RK is maintained by the secondary source in the event of a failure of the primary source, is preferably long enough that an emergency operation phase is provided, during which the oxygen content in the protected area does not exceed the design concentration AK, and thus, the ignition of materials in the protected area continues to be prevented.

Figure 2:
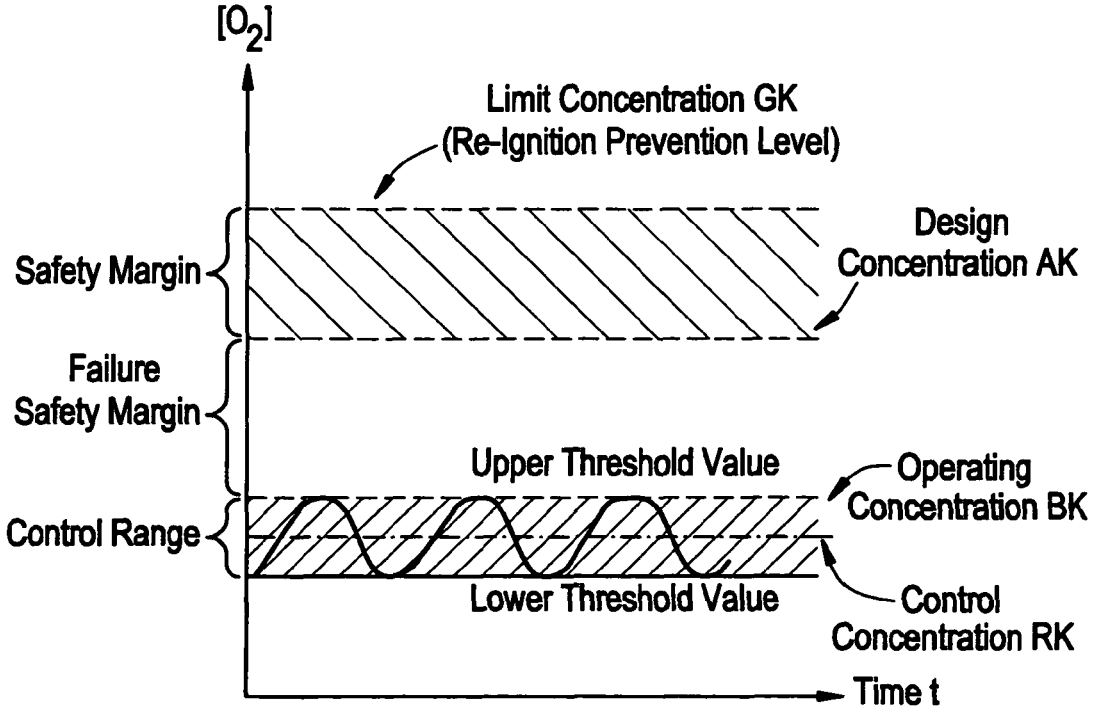
FIG. 2 shows a section of a course over time of the oxygen concentration in a protected area, with the operating concentration and the control concentration of the oxygen content according to the second alternative of the inertization method according to the invention being lowered to below the design concentration of the protected area.

FIG. 2 shows a section of a course over time of the oxygen concentration in a protected area, with the operating concentration BK and the control concentration RK of the oxygen content according to the second alternative of the inertization method according to the invention being lowered to below the design concentration AK of the protected area. The difference to FIG. 1 is that in this case the design concentration AK no longer agrees with the operating concentration BK. Instead, the operating concentration BK and hence also the control concentration RK along with the associated control range are shifted downward, with the margin between the design concentration AK and the operating concentration BK corresponding to a failure safety margin ASA. In the scenario illustrated in FIG. 2, the oxygen concentration in the protected area is maintained in the control range around the control concentration RK by alternately turning the primary source on or off. To this end, it is provided that the failure safety margin ASA is selected such that in the event of a failure of the primary source the growth curve of the oxygen content in the protected area reaches the limit concentration BK and/or the re-ignition prevention level only in a defined period of time. This period of time is preferably selected such that an emergency operation phase is guaranteed, which is sufficiently long to continue to prevent the ignition and/or re-ignition of materials in the protected area before the fire prevention and/or fire extinguishing system is restarted.

Figure 3:
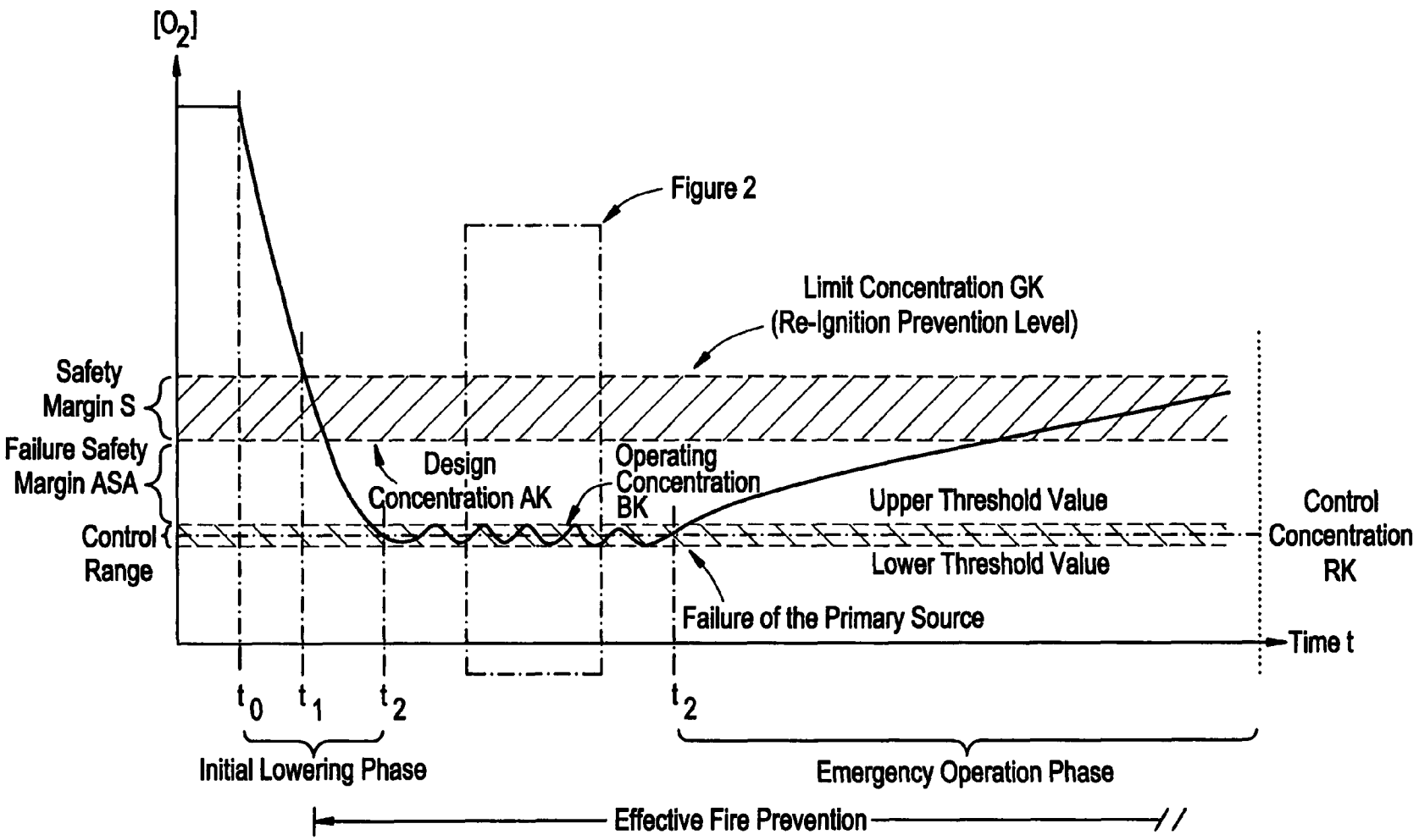
FIG. 3 shows a course of the oxygen content in a protected area, with the second alternative of the method according to the invention being implemented in the underlying inertization method.

FIG. 3 shows a course of the oxygen content in a protected area, the second alternative of the method according to the invention in the inertization method being implemented here. As already explained above in FIGS. 1 and 2, the y-axis represents the oxygen content in the protected area and the x-axis represents time. As shown in FIG. 3, initially an oxygen concentration of 21% by volume is present in the protected area.

Following an initial prophylactic lowering phase by a fire prevention system starting at the time $t_o$, the oxygen content in the protected area is reduced quickly to the control concentration RK. As illustrated, the oxygen concentration in the protected area reaches the re-ignition prevention level and/or the limit concentration GK at the time $t_1$ and the control concentration RK at the time $t_2$. The time period from $t_0$ to $t_2$ is referred to as the initial lowering phase.

In order to prevent materials present in the protected area from igniting following the initial lowering phase, a fire protection phase directly follows the initial lowering phase for the purpose of effective fire prevention. During this phase, the oxygen concentration in the protected area is maintained below the re-ignition prevention level and/or the limit concentration GK. Typically this occurs in that inert gas and/or oxygen-displacing gas is fed from the primary source into the protected area as needed in order to maintain the oxygen concentration in the control range around the control concentration RK and/or below the operating concentration BK.

In the event of a failure of the primary source, it is provided according to the invention that the failure safety margin ASA between the limit concentration GK and the operating concentration BK is so large that the growth curve of the oxygen content only reaches the limit concentration GK in a defined period z, thus achieving a sufficiently long emergency operation phase.

For explanation purposes it shall be pointed out that FIG. 3 illustrates the section that is shown in an enlarged scale in FIG. 2.

While there have been described what are considered to be exemplary embodiments of the invention, it will be apparent to those skilled in the art that various modifications may be made therein, and it is intended in the appended claims to cover such modifications and changes as fall within the scope thereof.

What is claimed is:

1. An inertization method for reducing the risk of fire in an enclosed protected area, in which the oxygen content in the protected area is maintained for a defined period at a control concentration (RK) below an operating concentration (BK) by feeding an oxygen-displacing gas from a primary source;

wherein the control concentration (RK) and the operating concentration (BK) are lowered so far below the design concentration (AK) defined for the protected area that the growth curve of the oxygen content reaches a limit concentration (GK) defined for the protected area only in a predefined time when the primary source fails, the margin between the design concentration (AK) and the operating concentration (BK) corresponding to a failure safety margin (ASA), and wherein the control concentration (RK) corresponds to the limit concentration (GK) less the failure safety margin (ASA) and a safety margin (S), such that the oxygen content in the protected area is reduced to the control concentration (RK) which is so much lower than the limit concentration (GK) that the growth curve of the oxygen content reaches the limit concentration (GK) only after a certain period of time in the event that the primary source fails.

2. An inertization method according to claim 1, wherein the failure safety margin (ASA) is determined by taking an air change rate applicable for the protected area, in particular the $n_{50}$ value for the protected area, and/or the pressure differential between the protected area and the surrounding area into consideration.

3. An inertization method according to claim 1, wherein a detector is provided for detecting a fire parameter, and wherein the oxygen content in the protected area is lowered quickly to the control concentration upon detecting an incipient fire or a fire when the oxygen content was previously at a higher level.

4. An inertization method according to claim 1, wherein a control range of about ±0.2% by volume oxygen content is provided around the control concentration (RK).

5. An inertization method according to claim 1, wherein the oxygen content in the protected area is controlled with respect to the air change rate, in particular the $n_{50}$ value of the protected area, and/or the pressure differential between the protected area and the surrounding area.

6. An inertization method according to claim 1, wherein the amount of the extinguishing agent for maintaining the control concentration (RK) in the protected area is calculated with respect to the air change rate of the target area, in particular the $n_{50}$ value of the protected area, and/or the pressure differential between the target area and the surrounding area.

7. A device for implementing the method according to one of claims 1, 2 and 3 to 6, wherein the primary source is at least a machine that is designed for producing oxygen-displacing gas, an array of compressed inert gas bottles, a buffer volume or a deoxydation machine.

* * * * *